US007338185B2

(12) United States Patent
Jenkins

(10) Patent No.: US 7,338,185 B2
(45) Date of Patent: Mar. 4, 2008

(54) FUTURISTIC CHRISTMAS ORNAMENT

(76) Inventor: William T. Jenkins, 184 Lester, Park Forest, IL (US) 60466

( * ) Notice: Subject to any disclaimer, the term of this patent is extended or adjusted under 35 U.S.C. 154(b) by 0 days.

(21) Appl. No.: 11/176,897

(22) Filed: Jul. 6, 2005

(65) Prior Publication Data

US 2007/0008737 A1 Jan. 11, 2007

(51) Int. Cl.
*F21V 13/14* (2006.01)

(52) U.S. Cl. ..... 362/252; 362/806; 362/123

(58) Field of Classification Search ..... 362/806–807, 362/252, 249, 563–566, 605, 555, 568, 123; 428/18–19
See application file for complete search history.

(56) References Cited

U.S. PATENT DOCUMENTS

| | | | |
|---|---|---|---|
| D167,216 | S | 7/1952 | Leech |
| 2,849,601 | A | 8/1958 | Walzer |
| D253,228 | S | 10/1979 | Campbell et al. |
| D254,190 | S | 2/1980 | Campbell et al. |
| D278,988 | S | 5/1985 | Steiner |
| 4,517,040 | A | 5/1985 | Whitted |
| 4,652,980 | A | 3/1987 | Segan |
| 4,833,580 | A | 5/1989 | Allen |
| D309,875 | S | 8/1990 | Talevski |
| D321,671 | S | 11/1991 | Goonen |
| RE34,717 | E | 9/1994 | Sanders et al. |
| 5,378,512 | A | 1/1995 | Van Wyk |
| D364,578 | S | 11/1995 | Gloston |
| D365,298 | S | 12/1995 | Dixon |
| D370,643 | S | 6/1996 | Kapp |
| 5,550,319 | A | 8/1996 | Segan et al. |
| 5,576,078 | A | 11/1996 | Schatz |
| D397,956 | S | 9/1998 | Lee |
| D405,714 | S | 2/1999 | Lewis |
| 5,876,109 | A | 3/1999 | Scalco |
| D413,545 | S | 9/1999 | Danon et al. |
| D415,714 | S | 10/1999 | Danon et al. |
| 6,398,388 | B1 | 6/2002 | Lorenzana et al. |
| D461,428 | S | 8/2002 | Danon et al. |
| 6,431,729 | B1 * | 8/2002 | Chen ..... 362/249 |
| 6,439,723 | B1 | 8/2002 | Tano |
| 6,503,605 | B1 | 1/2003 | Paul-Lieberman |
| 6,512,460 | B1 | 1/2003 | Prechel et al. |
| 6,520,656 | B2 | 2/2003 | Park et al. |
| D472,182 | S | 3/2003 | Whitman |
| D473,485 | S | 4/2003 | Danon et al. |
| 6,543,905 | B1 | 4/2003 | Adams et al. |
| 6,552,831 | B2 | 4/2003 | Odhner et al. |
| 2001/0002880 | A1 | 6/2001 | Talma |
| 2001/0024303 | A1 | 9/2001 | Odnher |
| 2003/0079387 | A1 * | 5/2003 | Derose ..... 40/544 |
| 2003/0156429 | A1 | 8/2003 | MacDonald |
| 2003/0161145 | A1 | 8/2003 | Liu et al. |
| 2003/0184829 | A1 | 10/2003 | Odhner et al. |
| 2003/0189820 | A1 | 10/2003 | Tell et al. |
| 2004/0007710 | A1 | 1/2004 | Roy et al. |
| 2004/0032732 | A1 | 2/2004 | Rubin |

(Continued)

*Primary Examiner*—Thomas M. Sember
*Assistant Examiner*—Julie A. Shallenberger
(74) *Attorney, Agent, or Firm*—Michael R. McKenna; Patrick N. Burkhart

(57) ABSTRACT

This futuristic Christmas ornament has at least one externally illuminated light transmissive tube extending out of a hollow body which holds the light source internally. The power source can be a battery that is also within the hollow body or a low voltage electric feed with a plug connector.

22 Claims, 2 Drawing Sheets

U.S. PATENT DOCUMENTS

2004/0076387 A1* 4/2004 Gaillard ..... 385/104
2004/0130890 A1 7/2004 Lopez
2005/0180163 A1* 8/2005 Huang ..... 362/568

* cited by examiner

FUTURISTIC CHRISTMAS ORNAMENT

BACKGROUND OF THE INVENTION

This invention relates to a futuristic Christmas ornament with a light transmissive tube extending outside of a hollow body. Light emanating from the a light source inside the hollow body illuminates at least a portion of the light transmissive tube extending outside of the hollow body. Preferably, a plurality of parallel light transmissive tubes are illuminated in this way to create a unique lighted decorative article.

Alternative technology is available in the form of U.S. Pat. No. 6,543,905 issued in 2003 to Adams et al. for a tree shaped holiday light holder made of a translucent material; pending U.S. Patent Application 2004/0032732 published in February, 2004, to Rubin which teaches a miniature portable illuminated tree shaped ornament with an illumination source including a blinking LED, fiber optics, or bulbs configured according to a previously determined pattern; U.S. Pat. No. 6,520,656 issued to Park et al. in 2003 for an ornament for body ornamentation or decoration using chemical light which has a body of transparent material which is adapted to receive an illumination source within a recess formed within the body to illuminate the ornament; U.S. Pat. No. 5,876,109 issued in 1999 to Scalco for lighted jewelry ornaments including a decorative body element of a light transmitting material, wherein the body includes a recess for receiving an LED for illuminating the decorative body; and U.S. Pat. No. 4,833,580 issued in 1989 to Allen for an illuminated decorative ornament having a body for receiving a light source. Also U.S. Pat. No. 6,398,388 issued in 2002 to Lrenzanna et al. and U.S. Pat. No. 2,849,601 issued to Walzer in 1956, both for an illuminated ornament having an overall shape of a Christmas tree. Also see U.S. Design Patent No. D397,956 issued in 1998 to Lee for a tree ornament and U.S. Design Patent No. D167,216 issued to Leech in 1951 for a rotatable illuminable Christmas tree. None of the foregoing devices project light from inside an ornament body into a light transmissive external appendage.

To alleviate this problem, and others which will become apparent from the disclosure which follows, the present invention conveniently projects light along a predetermined path outside of the body of the futuristic Christmas ornament.

The citation of the foregoing publications is not an admission that any particular publication constitutes prior art, or that any publication alone or in conjunction with others, renders unpatentable any pending claim of the present application. None of the cited publications is believed to detract from the patentability of the claimed invention.

ADVANTAGES OF THIS INVENTION

The present invention conveniently projects light along a predetermined path through a light transmissive element outside of the body of the futuristic Christmas ornament. The light originates within the body of the ornament and emanates from the light source disposed inside the body of the ornament illuminating at least a portion of the light transmissive tube extending outside of the hollow body.

Another advantage over all of the foregoing devices is that the futuristic Christmas ornament may have a plurality of uniquely arranged light transmissive tubes to create an effect not possible with the art identified above. Moreover, the futuristic Christmas ornaments contemplated by this important invention teaches the use of multiple LEDs ("light emitting diodes") disposed internally in the body of the ornament that are powered through a plug connection by a standard Christmas light power line. Thus, ornaments in accordance with the disclosure herein may be substituted for miniature lights from a string of Christmas tree lights to create a visually enhanced ornament for use on Christmas trees and the like.

These together with other objects of the invention, along with the various features of novelty which characterize the invention are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

Still other advantages will be apparent from the disclosure that follows.

SUMMARY OF THE INVENTION

The invention relates to a futuristic Christmas ornament with at least one light transmissive tube, a hollow body, at least one light source, and at least one power source. Each of the at least one light transmissive tube is illuminated externally of the hollow body by the at least one light source that is disposed inside the hollow body and the at least one power source is operably associated with the at least one light source. In this way, light emanating from the at least one light source disposed inside the hollow body illuminates at least a portion of the at least one light transmissive tube extending outside of the hollow body.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWING

Preferred embodiments of the invention are described hereinafter with reference to the accompanying drawing wherein.

DETAILED DESCRIPTION OF THE INVENTION

Figure 1:
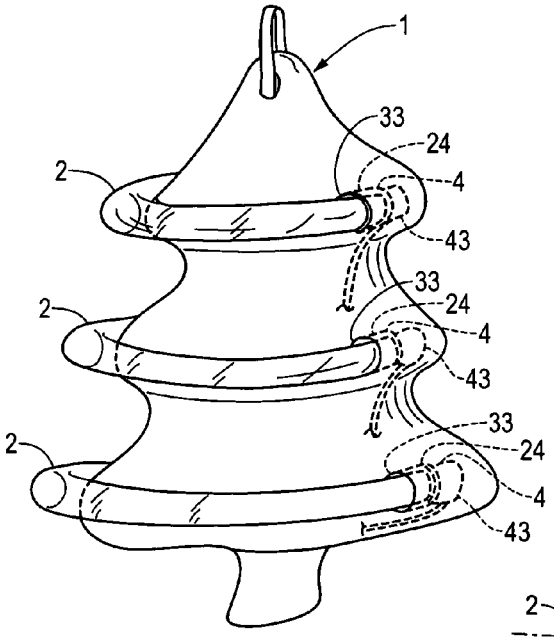
FIG. 1 is a perspective view of the futuristic Christmas ornament of the present invention showing a hollow body shaped like an evergreen tree with three light transmissive tubes extending from the hollow body, each of said tubes extending into the hollow body with an individual light source for each tube that may be adapted to flash at different rates to cause an effect and each light source may be powered by a distinct power source, and the top of the hollow body has an aperture for receiving a ring for hanging the ornament.

The preferred embodiments depicted in the drawing comprise a futuristic Christmas ornament in accordance with the disclosure made herein. Without departing from the generality of the invention disclosed herein and without limiting the scope of the invention, the discussion that follows, will refer to the invention as depicted in the drawing.

The preferred embodiments of the apparatus depicted in the drawing comprise a futuristic Christmas ornament 1 is taught by the instant invention comprising at least one light transmissive tube 2, a hollow body 3, at least one light source 4, and at least one power source 5. Each of the at least one light transmissive tube 2 has a first end 12 and a second end 22. The hollow body 3 has a top end 13 and a base 23 at a bottom end and at least one opening for each of the at least one light transmissive tube 2 for receiving the first end 12 thereof. A substantial portion of each of the at least one light transmissive tube 2 extends outside of the hollow body 3. The at least one light source 4 disposed inside the hollow body 3 is operably associated with the first end 12 of at least one of the at least one light transmissive tube 2; and the at least one power source 5 is operably associated with the at least one light source 4. In this way, light emanating from the at least one light source 4 disposed inside the hollow body 3 illuminates at least a portion of the at least one light transmissive tube 2 extending outside of the hollow body 3.

The light source 4 may include a small bulb 14, fiber optic, LED 24 or the like. The light source 4 could be continuous or intermittent with flashing multi-color, including red, green and blue. The power source 5 may be a battery 15 or a connect able electric feed. Two triple-A batteries at 3 volts could power the continuous LEDs 24, while flashing LEDs could easily operate on three triple-A batteries at 4.5 volts. The light transmissive tube 2 may be tinted or clear, and it preferably flexible. One-quarter inch vinyl airline tubing is a viable option.

Figure 4:
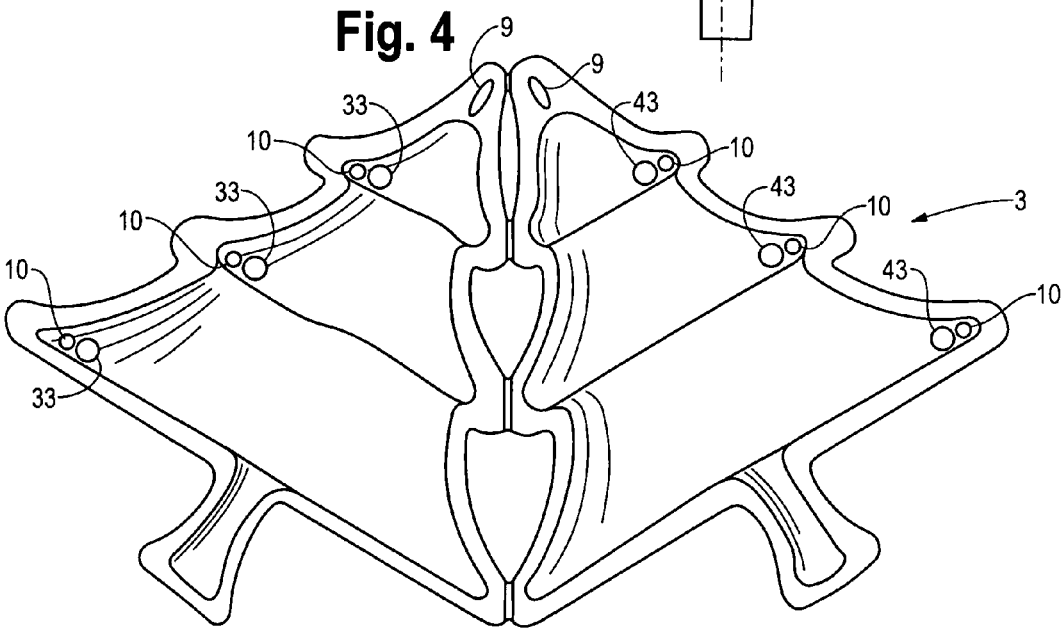
FIG. 4 is a perspective view of two mirror-images shells that may be hinged or otherwise connected together to form the hollow body, and further showing an opening for each of the first end and the second end of each of three light transmissive tubes.

Preferably, as best shown in FIG. 4, the hollow body 3 of the futuristic Christmas ornament 1 has a first opening 33 and a second opening 43 for each of the at least one light transmissive tube 2 for respectively receiving the first end 12 and the second end 22 of one of the at least one light transmissive tube 2. Moreover, the at least one light source 4 disposed inside the hollow body 3 that is operably associated with the first end 12 of one of the at least one light transmissive tube 2 may further be operably associated with the second end 22 of the one of the at least one light transmissive tube 2. Additionally, the number of the at least one light source 4 may equal the number of each of the first end 12 and the second end 22 of the at least one light transmissive tube 2 and each of the at least one light source 4 can be operably associated with one of the first end 12 and the second end 22 of one of the at least one light transmissive tube 2.

Figure 3:
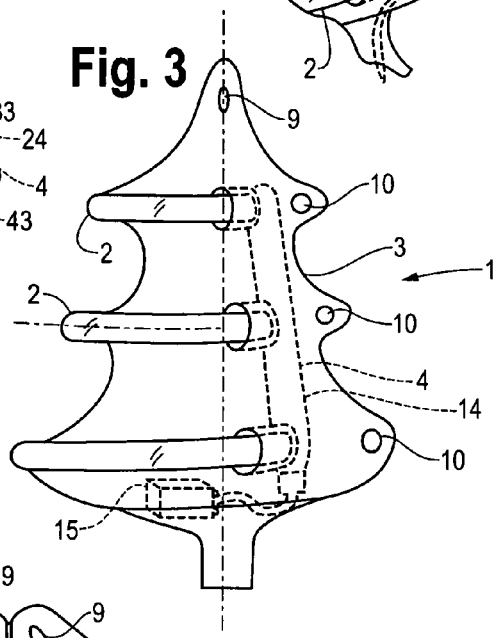
FIG. 3 is a side elevation view of the futuristic Christmas ornament with one light source for a plurality of horizontally disposed light transmissive tubes powered by a battery also disposed within the hollow body, and both decorative and functional holes disposed along the side of the hollow body (on the right side as shown in FIG. 3) for ornamentation and to support the body from the branch of a Christmas tree.

As shown in FIG. 3, the hollow body 3 of the futuristic Christmas ornament 1 may have a generally upright centerline 6, and each of the at least one light transmissive tube 2 may lie in a plane that is perpendicular to the generally upright centerline 6. As shown in FIG. 3, each of the at least one light transmissive tube 2 may be horizontally disposed.

Figure 5:
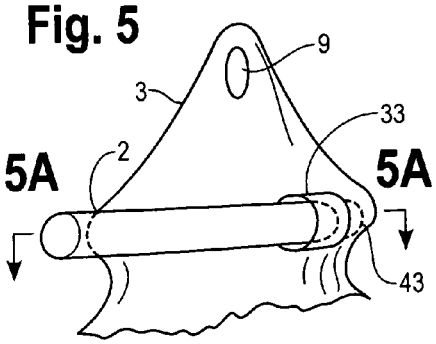
FIG. 5 is a fragmentary side elevation view of the top portion of the futuristic Christmas ornament of the present invention showing one light transmissive tube extending outside of the hollow body.
Figure 5A:
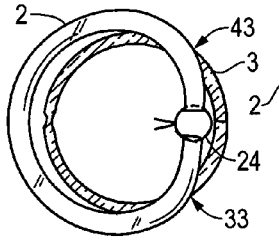
FIG. 5A is a cross-sectional view taken along lines 5A-5A of FIG. 5 showing one light source connected to the first end and the second end of the light transmissive tube.
Figure 8:
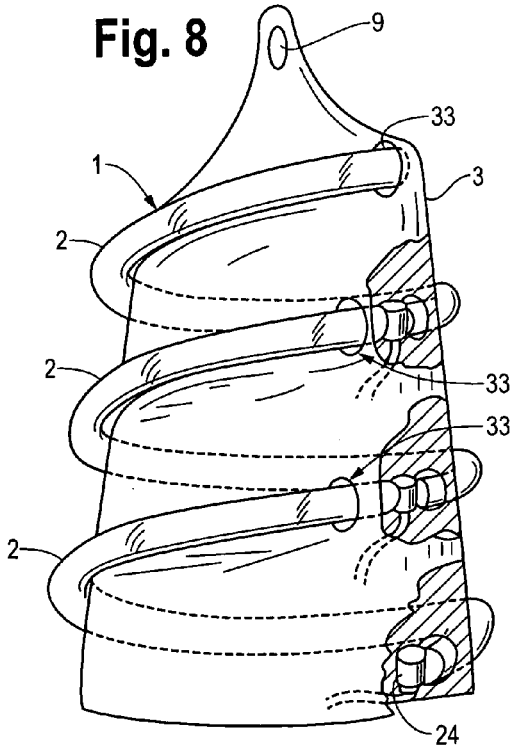
FIG. 8 is a perspective view of the futuristic Christmas ornament of the present invention showing a plurality of light transmissive tubes spirally disposed relative to the upright body.

While any decorative shape for the hollow body may be used (see FIGS. 1 and 8), each of the at least one light transmissive tube 2 preferably forms a generally horizontal portion of a toroid, i.e. a doughnut shaped element, outside of the hollow body 3. Where the at least one light transmissive tube 2 comprises a plurality of light transmissive tubes 2, each of the plurality of light transmissive tubes 2 is preferably a portion of a toroid lying in one of a plurality of parallel planes. As shown in FIGS. 1 and 3, the plurality of light transmissive tubes may be stacked vertically with each of the plurality of light transmissive tubes having a progressively larger diameter from top to bottom. As seen in FIG. 5C, each of the plurality of a portion of a toroid lying in one of a plurality of parallel planes can be approximately 330 degrees.

The hollow body may have an aperture 9 on top for receiving a ring for hanging the ornament. Moreover, the hollow body may have holes 10 disposed along the side of the hollow body which are both decorative and functional for ornamentation and to support the body from the branch of a Christmas tree.

Figure 7:
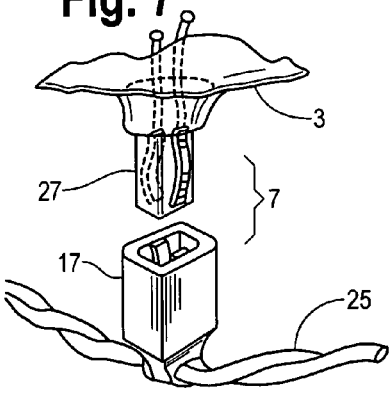
FIG. 7 is a fragmentary perspective view of the base of the hollow body with a male plug at the base exploded away from a compatible female plug connector of a low voltage power line.

The at least one power source 5 of the futuristic Christmas ornament 1 may be connected to the at least one light source 4 through a plug connector 7 at the base 23, as shown in FIG. 7. The plug connector 7 can extend from a low voltage power line 25. Preferably the plug connector 7 is a female connector 17 associated with a standard string of Christmas lights and the base 23 has a compatible male connector 27.

Figure 5B:
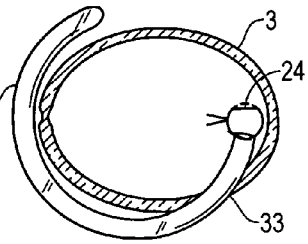
FIG. 5B is a cross-sectional view similar to FIG. 5A and showing a light transmissive tube extending from an opening in the hollow body that partially wraps around the hollow body without the second end re-entering the hollow body.
Figure 5C:
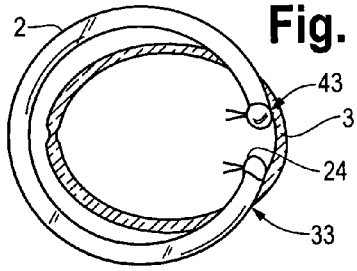
FIG. 5C is a cross-sectional view similar to FIG. 5A and showing a light transmissive tube having a first end penetrating an opening in the hollow body and a second end penetrating another opening in the hollow body with each of the first end and second end having a distinct light source for projecting light through the light transmissive tube.

As shown in FIGS. 1 and 5B, the at least one light source 4 of the futuristic Christmas ornament 1 may be equal in number to the number of the at least one light transmissive tube 2, and each of the at least one light source 4 is operably associated with the first end 12 of each of the at least one light transmissive tube 2. The at least one power source 5 may comprise a battery 15 and the battery 15 is preferably disposed inside the hollow body 3.

Figure 6:
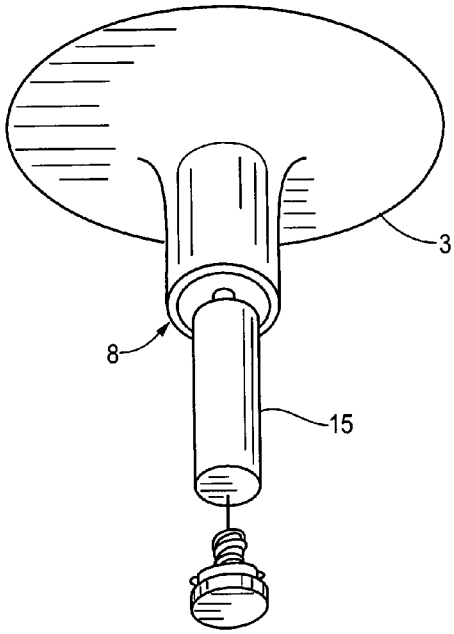
FIG. 6 is a fragmentary view of the base of the hollow body showing a means for accessing an interior space within the hollow body.

Referring to FIG. 5, the futuristic Christmas ornament 1 is preferably made with at least a portion of the hollow body 3 being translucent. The hollow body 3 may be made from a variety of materials, including but not limited to plexiglass, plastic, glass, stone or other decorative material. The hollow body 3 may comprise two mirror-image concave shells with each shell having a peripheral edge, and the hollow body 3 being formed by joining together the two shells along their respective peripheral edge. Alternatively, the hollow body 3 may comprise means 8 for accessing an interior space within the hollow body 3 as shown in FIG. 6.

Figure 2:
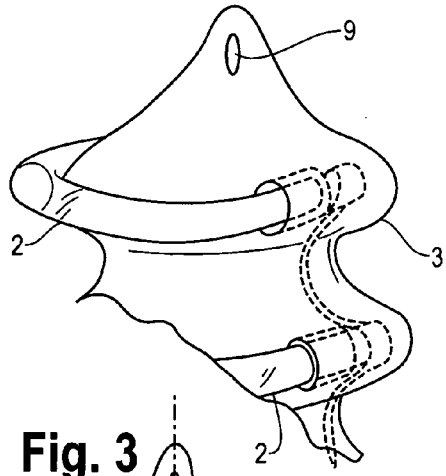
FIG. 2 is a fragmentary perspective view of the futuristic Christmas ornament of the present invention with the each light source powered in parallel by the power source.

As shown in FIGS. 1-3, the futuristic Christmas ornament 1 preferably comprises a plurality of light transmissive tubes, a hollow body 3, at least one power source 5, and at least one light source 4. Each of the plurality of light transmissive tubes is a portion of a toroid lying in one of a plurality of parallel planes, and each of the plurality of light transmissive tubes 2 has a first end 12 and a second end 22. The hollow body 3 has a first opening 33 and a second opening 43 for each of the plurality of light transmissive tubes for receiving the first end 12 thereof, wherein a substantial portion of each of the plurality of light transmissive tubes extend outside of the hollow body 3, the hollow body 3 has a top end 13 and a base 23 at a bottom end, the hollow body 3 has a generally upright centerline 6, and each of the plurality of light transmissive tubes lies in a plane that is near perpendicular to the upright centerline 6. At least a portion of the hollow body 3 is translucent and at least one light source 4 disposed inside the hollow body 3 is operably associated with at least one of the first end 12 and the second end 22 of at least one of the plurality of light transmissive tubes. At least one power source 5 is operably associated with the at least one light source 4, so that, light emanating from the at least one light source 4 disposed inside the hollow body 3 illuminates the translucent hollow body 3 and at least a portion of the at least one of the plurality of light transmissive tubes extending outside of the hollow body 3.

Referring to FIG. 5, a futuristic Christmas ornament 1 is shown comprising a plurality of light transmissive tubes 2, a hollow body 3, at least one light source 4, and at least one power source. 5. Each of the plurality of light transmissive tubes is a portion of a toroid lying in one of a plurality of parallel planes and each of the plurality of light transmissive tubes has a first end 12 and a second end 22. The hollow body 3 has a first opening 33 and a second opening 43 for each of the plurality of light transmissive tubes for receiving the first end 12 thereof. A substantial portion of each of the plurality of light transmissive tubes extends outside of the hollow body 3, the hollow body 3 has a top end 13 and a base 23 at a bottom end, and the hollow body 3 has a generally upright centerline 6, and each of the plurality of light transmissive tubes lies in a plane that is near perpendicular to the upright centerline 6. At least a portion of the hollow body 3 is translucent.

Furthermore, at least one light source 4 disposed inside the hollow body 3 is operably associated with at least one of the first end 12 and the second end 22 of at least one of the plurality of light transmissive tubes 2; and at least one power source 5 operably connected to the at least one light source 4 through a plug connector 7 at the base 23, as shown in FIG. 7. The plug connector 7 extends from a low voltage power line 25, whereby, light emanating from the at least one light source 4 disposed inside the hollow body 3 illuminates the translucent hollow body and at least a portion of the at least one of the plurality of light transmissive tubes extending outside of the hollow body.

While this invention has been described in connection with the best mode presently contemplated by the inventor for carrying out his invention, the preferred embodiments described and shown are for purposes of illustration only, and are not to be construed as constituting any limitations of the invention. Modifications will be obvious to those skilled in the art, and all modifications that do not depart from the spirit of the invention are intended to be included within the scope of the appended claims. Those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

My invention resides not in any one of these features per se, but rather in the particular combinations of some or all of them herein disclosed and claimed and it is distinguished from the prior art in these particular combinations of some or all of its structures for the functions specified.

With respect to the above description then, it is to be realized that the optimum dimensional relationships for the parts of the invention, including variations in size, materials, shape, form, function and manner of operation, assembly and use, and all equivalent relationships to those illustrated in the drawings and described in the specification, that would be deemed readily apparent and obvious to one skilled in the art, are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A futuristic Christmas ornament comprising:

a. at least one light transmissive tube, i. each of said at least one light transmissive tube having a first end and a second end;

b. a hollow body with at least one opening for each of the at least one light transmissive tube for receiving the first end thereof, i. a substantial portion of each of the at least one light transmissive tube extending outside of the hollow body, ii. said hollow body having a top end and a base at a bottom end, the hollow body having a first opening and a second opening for each of the at least one light transmissive tube for respectively receiving the first end and the second end of one of the at least one light transmissive tube;

c. at least one light source disposed inside the hollow body being operably associated with the first end of at least one of the at least one light transmissive tube; and d. at least one power source operably associated with the at least one light source, whereby, light emanating from the at least one light source disposed inside the hollow body illuminates at least a portion of the at least one light transmissive tube extending outside of the hollow body.

2. The futuristic Christmas ornament of claim 1, wherein the at least one light source disposed inside the hollow body that is operably associated with the first end of one of the at least one light transmissive tube is further operably associated with the second end of said one of the at least one light transmissive tube.

3. The futuristic Christmas ornament of claim 1, wherein the number of the at least one light source equals the number of each of the first end and the second end of the at least one light transmissive tube and each of the at least one light source is operably associated with one of the first end and the second end of one of the at least one light transmissive tube.

4. The futuristic Christmas ornament of claim 1, wherein the hollow body has a generally upright centerline, and each of said at least one light transmissive tube lies in a plane that is perpendicular to the generally upright centerline.

5. The futuristic Christmas ornament of claim 1, wherein each of said at least one light transmissive tube is horizontally disposed.

6. The futuristic Christmas ornament of claim 1, wherein said at least one light transmissive tube is spirally disposed relative to the generally upright centerline.

7. The futuristic Christmas ornament of claim 1, wherein each of said at least one light transmissive tube forms a generally horizontal portion of a toroid outside of the hollow body.

8. The futuristic Christmas ornament of claim 1, wherein the at least one light transmissive tube comprises a plurality of light transmissive tubes, a. each of said plurality of light transmissive tubes being a portion of a toroid lying in one of a plurality of parallel planes.

9. The futuristic Christmas ornament of claim 1, wherein the plurality of light transmissive tubes are stacked vertically with each of the plurality of light transmissive tubes having a progressively larger diameter from top to bottom.

10. The futuristic Christmas ornament of claim 1, wherein each of the plurality of portions of a toroid lying in one of a plurality of parallel planes is approximately 330 degrees.

11. The futuristic Christmas ornament of claim 1, wherein the at least one power source is connected to the at least one light source through a plug connector at the base, said plug connector extending from a low voltage power line.

12. The futuristic Christmas ornament of claim 1, wherein the plug connector is a female connector associated with a standard string of Christmas lights and the base has a compatible male connector.

13. The futuristic Christmas ornament of claim 1, wherein at least a portion of the hollow body is translucent.

14. The futuristic Christmas ornament of claim 1, wherein the at least one light source is equal in number to the number of the at least one light transmissive tube, and each of the at least one light source is operably associated with the first end of each of the at least one light transmissive tube.

15. The futuristic Christmas ornament of claim 1, wherein the hollow body comprises two mirror-image concave shells, each shell having a peripheral edge, and said hollow body being formed by joining together the two shells along their respective peripheral edge.

16. The futuristic Christmas ornament of claim 1, wherein the hollow body has at least one passageway equal in number to the number of the at least one light transmissive tube, each said at least one passageway passing through each of the two mirror image shells to form a visible hole in the hollow body, each visible hole lying in a plane of one of the at least one light transmissive tube.

17. The futuristic Christmas ornament of claim 1, wherein the hollow body comprises means for accessing an interior space within the hollow body.

18. The futuristic Christmas ornament of claim 1, wherein the at least one power source comprises a battery.

19. The futuristic Christmas ornament of claim 1, wherein the battery is disposed inside the hollow body.

20. The futuristic Christmas ornament of claim 1, wherein at least a portion of the hollow body is translucent.

21. A futuristic Christmas ornament comprising:

a. a plurality of light transmissive tubes, i. each of said plurality of light transmissive tubes being a parallel portion of a toroid, ii. each of said plurality of light transmissive tubes having a first end and a second end;

b. a hollow body with a first opening and a second opening for each of the plurality of light transmissive tubes for receiving the first end thereof, wherein i. a substantial portion of each of the plurality of light transmissive tubes extending outside of the hollow body, ii. said hollow body having a top end and a base at a bottom end, iii. said hollow body having a generally upright centerline, and each of said plurality of light transmissive tubes lies in a plane that is near perpendicular to the upright centerline, iv. at least a portion of the hollow body is translucent, c. at least one light source disposed inside the hollow body being operably associated with at least one of the first end and the second end of at least one of the plurality of light transmissive tubes; and d. at least one power source operably associated with the at least one light source, whereby, light emanating from the at least one light source disposed inside the hollow body illuminates the translucent hollow body and at least a portion of the at least one of the plurality of light transmissive tubes extending outside of the hollow body.

22. A futuristic Christmas ornament comprising:

a. a plurality of light transmissive tubes, i. each of said plurality of light transmissive tubes being a parallel portion of a toroid, ii. each of said plurality of light transmissive tubes having a first end and a second end;

b. a hollow body with a first opening and a second opening for each of the plurality of light transmissive tubes for receiving the first end thereof, i. a substantial portion of each of the plurality of light transmissive tubes extending outside of the hollow body, ii. said hollow body having a top end and a base at a bottom end, iii. said hollow body having a generally upright centerline, and each of said plurality of light transmissive tubes lies in a plane that is near perpendicular to the upright centerline, iv. at least a portion of the hollow body is translucent, v. at least one light source disposed inside the hollow body being operably associated with at least one of the first end and the second end of at least one of the plurality of light transmissive tubes; and c. at least one power source operably connected to the at least one light source through a plug connector at the base, said plug connector extending from a low voltage power line, whereby, light emanating from the at least one light source disposed inside the hollow body illuminates the translucent hollow body and at least a portion of the at least one of the plurality of light transmissive tubes extending outside of the hollow body.

* * * * *